United States Patent [19]

Bennett

[11] 4,441,633

[45] Apr. 10, 1984

[54] CHILD RESISTANT TRIGGER PUMP

[76] Inventor: Robert A. Bennett, 170 Sturbridge Rd., Easton, Conn. 06425

[21] Appl. No.: 314,782

[22] Filed: Oct. 26, 1981

[51] Int. Cl.[3] ..... B05B 11/00

[52] U.S. Cl. ..... 222/153; 222/384; 239/359

[58] Field of Search ..... 222/153, 207, 321, 383, 222/384, 340–341, 402.11; 215/216, 221; 239/359

[56] References Cited

U.S. PATENT DOCUMENTS

| | | | |
|---|---|---|---|
| 3,927,834 | 12/1975 | Tada | 222/383 X |
| 3,973,700 | 8/1976 | Schmidt et al. | 222/153 |
| 4,204,614 | 5/1980 | Reeve | 222/153 |
| 4,346,821 | 8/1982 | Wesner et al. | 222/153 |
| 4,373,644 | 2/1983 | Bennett | 222/153 |

*Primary Examiner*—Joseph J. Rolla
*Assistant Examiner*—R. Stormer

[57] ABSTRACT

A manually operable trigger pump has a pump body, a circular cap disposed below the body and adapted to engage a container having material to be pumped out, a generally vertical trigger pivotally coupled at its upper end to the body and a linkage coupled at one end to the trigger intermediate its ends and extending from the coupled end into the body. The trigger has a surface adjacent the body. The surface has a longitudinally extending groove therein. A locking device is detachably securable to and is manually rotatable about the cap. A generally horizontal arm integral at one end with the device extends radially outward from the cap. The other end of the arm has a tip which is engagable with and disengagable from the trigger surface groove. The device is rotatable to a locked position at which the tip engages the groove. At this point, when the trigger is squeezed, the movement of the trigger is insufficient to actuate the pump. However, if the trigger is pivoted in opposite direction and at the same time the device is rotated to move the tip out of engagement with the groove, the pump is then unlocked and can be operated normally.

6 Claims, 7 Drawing Figures

CHILD RESISTANT TRIGGER PUMP

BACKGROUND OF THE INVENTION

Disposable or rechargeable liquid spray dispensers are widely used. Typically, such dispensers employ a liquid carrying container with a manually operable pump connected thereto. These dispensers are designed for ease of operation and typically can be operated by young children as well as adults. Under certain conditions, as for example when the liquid is a poison such as an insecticide, safety regulations require the pump to be of child resistant type, i.e., that the pump should be so designed that it can be locked into an inoperative position and when so locked, that it cannot be unlocked by a yound child. In order to satisfy this design requirement, the unlocking action must be of a type which requires the operator to perform two dissimilar operations on the pump to unlock it.

In my copending patent application entitled "Child Resistant Type Pump," filed Feb. 17, 1981, Ser. No. 234,928, I disclosed one solution to this problem. In accordance with the principles in said application, a manually operable pump has a pump body connected by a vertically downwardly extending throat by a circular internally threaded cap to a container having material to be pumped out. A generally vertical trigger is pivotally coupled at the upper end to the body and is disposed alongside the throat and cap. A linkage is coupled at one end to the trigger at a point intermediate the ends of the trigger and extends from the coupled end into the body. When the trigger is squeezed, it is pivoted in a vertical plane toward the body and, normally, will initiate the pumping process.

In order to provide the desired child resistant function, locking means is secured to and is manually rotatable about the cap. A generally horizontal arm, integral at one end with the means, extends radially outward from the cap. The arm has a radially extending recess in its top surface.

The means is rotatable to a locking position at which the other end of the arm is aligned with, but is spaced inwardly from, the trigger and at which the linkage engages the recess. The separation between the other end of the arm and the trigger is so small that, when the trigger is squeezed, the trigger will butt up against the other end and cannot move further. The total permitted movement of the trigger is insufficient to actuate the pump. However, the separation between the other end of the arm and the trigger is sufficiently large that when the trigger abuts the other end, the linkage is moved upward and is partially disengaged from the recess.

At this point, the means can be rotated manually to move the other end out of alignment with the trigger whereby the linkage will be completely disengaged from the recess. The pump is then unlocked and the trigger can be squeezed in the normal manner to operate the pump.

Since filing the above identified application, I have learned that certain types of pumps employ a generally vertical trigger having a surface which is adjacent the pump body and which has a longitudinally extending groove therein. When this type of trigger is employed, another somewhat simpler type of arm can be used with the locking means to produce the same child resistant action.

SUMMARY OF THE INVENTION

In accordance with the principles of this invention, a manually operable pump has a pump body connected by a vertically downwardly extending throat by a circular internally threaded cap to a container having material to be pumped out. A generally vertical trigger is pivotally coupled at the upper end to the body and is disposed alongside the throat and cap. A linkage is coupled at one end to the trigger at a point intermediate the ends of the trigger and extends from the coupled end into the body. The trigger has a surface adjacent the pump body and this surface has a longitudinally extending groove therein. When the trigger is squeezed, it is pivoted in a vertical plane toward the body and, normally, will initiate the pumping process.

In order to provide the desired child resistant function, locking means is detachably secured to and is manually rotatable about the cap. A generally horizontal arm, integral at one end with the means, extends radially outward from the cap. The other end of the arm has a tip which is engagable with and disengagable from the surface groove.

The means is rotatable to a locking position at which the tip engages the groove. The trigger movement under these conditions, when the trigger is squeezed, is insufficient to actuate the pump.

However, if the trigger is pivoted in the opposite direction and, at the same time, the means is rotated manually to move the tip out of engagement with the groove, the pump is then unlocked, and the trigger can be squeezed in the normal manner to operate the pump.

The locking means, when in position, not only prevents a child from operating the trigger; the means also prevents the child from obtaining access to the contents of the container. Access is blocked because the pump body and trigger are freely rotatable in the cap and the means is freely rotatable about the cap. Thus, if a child turns the pump body, the pump body, trigger and means turn as a unit, and the cap remains in position. The means surrounds the cap so a child cannot grasp the cap and accidentally or purposefully unscrew it.

DETAILED DESCRIPTION OF PREFERRED EMBODIMENT

Figure 1:
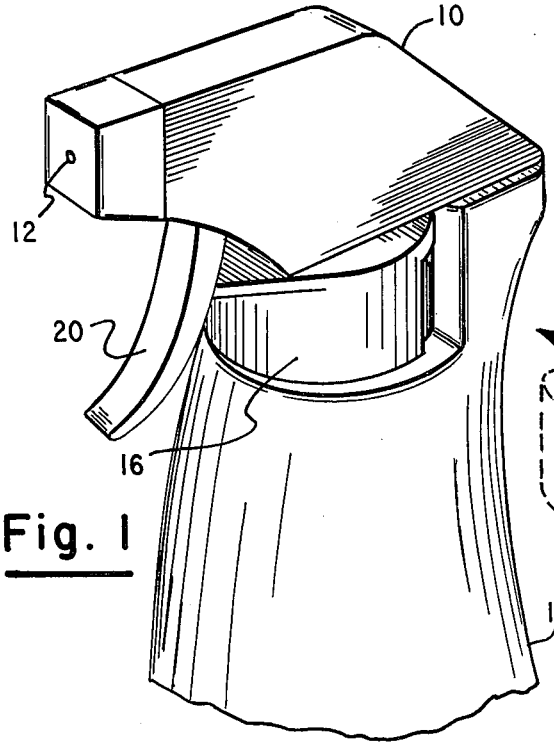
FIG. 1 is a perspective view of a trigger pump with a child resistant locking device separated therefrom.
Figure 2:
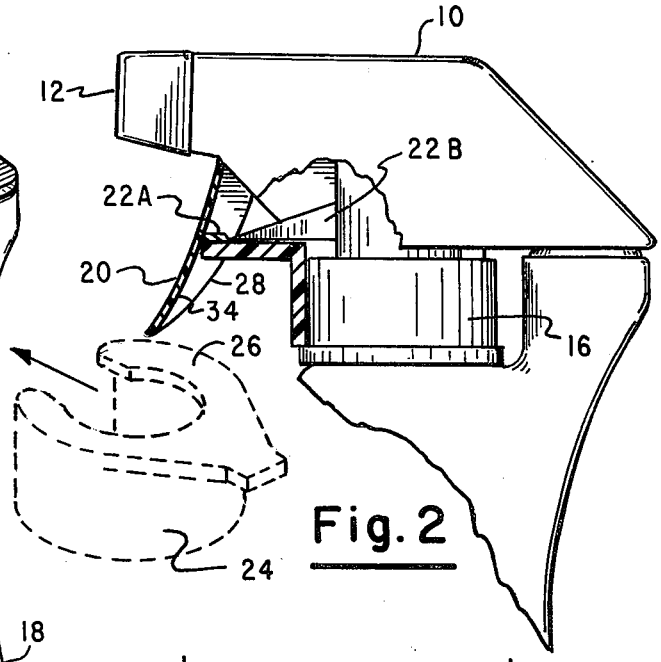
FIG. 2 is a detail partially cut away side view of the pump of FIG. 1 with the device of FIG. 1 secured thereto in locking position.

Referring now to FIGS. 1–7, a known type of trigger pump has a valve body 10 with a discharge nozzle 12 and a bottom vertical throat 14. The throat extends through a central opening in a circular cap 16 which detachably secures the throat to the neck of a container 18 of a suitable liquid substance. A trigger 20, generally vertical is pivotally secured at its upper end within the body 10. The trigger has a surface 28 adjacent the body and surface 28 has a longitudinally extending groove 34 therein. A linkage has a first section 22A which is coupled at one end to the trigger 20 at a point intermediate the ends of the trigger and is secured by a living hinge to a second section 22B which extends generally horizontally upwards into the body. The linkage is moved into the body when the trigger is squeezed and is pivoted in a vertical plane into the body of the valve. When the trigger is squeezed, a spray is discharged from the nozzle. When trigger pressure is released, the trigger will return automatically to its initial position.

In order to make the trigger pump child resistant, it is necessary to enable the pump to be locked in such manner that the spray cannot be produced by squeezing the trigger and further, to insure that any user must use a combination of two different types of motions to unlock the pump and enable it to be used in normal manner.

A child resistant locking device shown in phantom in FIG. 1 and elsewhere in solid line is detachably secured to the pump to provide the desired type of action.

The device includes an annular member 24 hollow and vertically disposed, open at both ends and in horizontal cross section having the general shape of a C. A flat top section 26 of like C shape but somewhat wider is integral with and overlies member 24. Section 26 has a flat top horizontal surface.

A generally horizontal arm identified at 30 has one end integral with section 26 and extends radially outward, oppositely disposed from the gap, to an opposite exposed end defining a tip 32. Tip 32 has a width which is slightly smaller than the width of groove 34. The tip can be engaged with groove 34 and, when engaged, extends deeply into the groove. The tip can also be disengaged from the groove.

Figure 3:
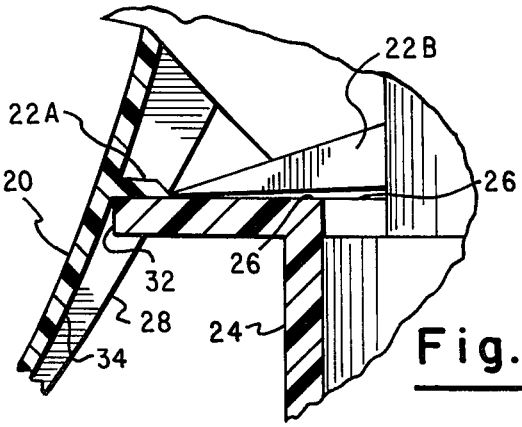
FIGS. 3 and 4 are detail views illustrating actuation of the trigger of the pump of FIG. 1 when the device of FIG. 1 is in locking position.
Figure 5:
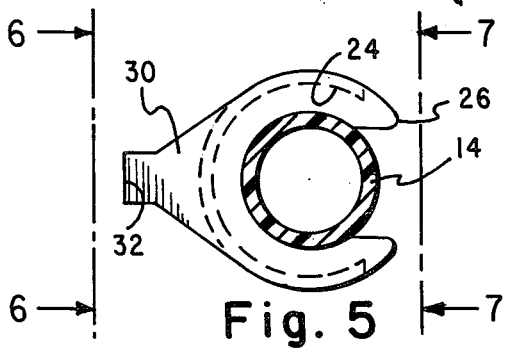
FIG. 5 is a plan view of the device shown in position about the throat of the pump.
Figure 6:
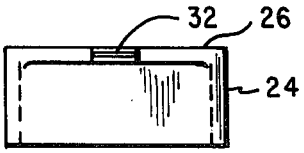
FIG. 6 is a view taken along line 6—6 in FIG. 5.
Figure 7:
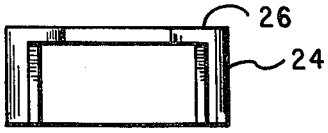
FIG. 7 is a view taken along line 7—7 in FIG. 5.
Figure 4:
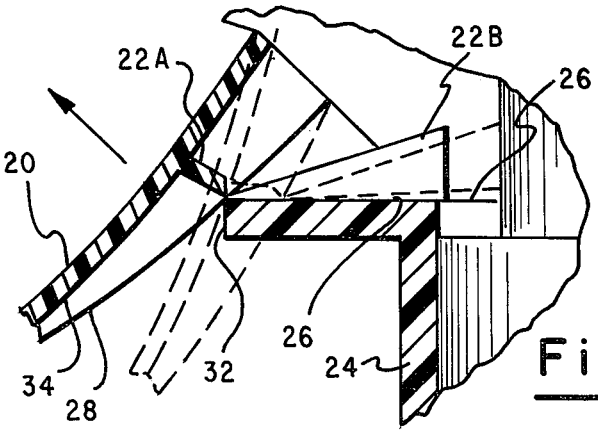

In use, the device is removably snapped onto cap 16 with section 26 resting on top of the cap. The device is manually rotatable about the cap. When the device is rotated until tip 32 is alighed with and engages the groove 34, the pump is locked. The trigger, when squeezed, can move inwardly only a small distance which is insufficient to enable the pump to be operated as shown in FIG. 3. However, as shown in FIG. 4, when the trigger is pivoted outwardly from the body in a direction opposite to the direction regulated for squeezing and is held in this position simultaneous manual rotation of the device will swing the tip out of alignment with the groove. The combination of the two motions, the pivoting of the trigger in the opposite direction and manual rotation, enables the pump to be unlocked and then to be operated in normal fashion.

The pump body, trigger and throat can be freely rotated as a unit within the cap. Moreover, the device is freely rotatable about the cap and effectively surrounds it. Thus, when the device is in position, a child attempting to unscrew the cap will only succeed in turning the pump body, trigger and device as a unit about the cap. The child cannot operate the pump or gain access to the contents of the container.

What is claimed is:

1. A device for use with a manually operable trigger pump having a pump body and a circular cap disposed below the body and adapted to engage a container having material to be pumped out by said pump, said pump having a generally vertical trigger pivotally coupled at its upper end to said body and a linkage coupled at one end to said trigger at a point intermediate the ends of the trigger, said trigger having a surface adjacent said body, said surface having a longitudinally extending groove therein, said linkage extending from said coupled end into said body, said linkage being moved into said body when said trigger is pivoted in a vertical plane toward said body to operate said pump, said device comprising:

locking means detachably securable to the outer surface of said cap in such manner as to be manually rotatable about said cap; and a generally horizontal arm integral at one end with said locking means and when said means is secured to the cap extending radially outward from said cap, the other end of said arm having a tip engageable with and disengagable from said trigger surface groove, said means when secured to said cap being rotatable to a locked position at which the tip engages said groove and the pivotable motion of said trigger toward the pump body is small enough to prevent trigger operation of the pump, whereby the pump is locked into an inoperative position, said pump being unlocked and in operative position when the trigger is pivoted in the opposite direction and the locking means is simultaneously rotated to move the tip out of engagement with the trigger surface whereby the trigger can be pivoted in normal operative manner.

2. The device of claim 1, wherein said means and arm constitute a unit which can be manually attached to and removed from said cap.

3. The device of claim 2, wherein said means has a generally annular shape.

4. The device of claim 3 wherein said means is an annular member which in horizontal cross section has the general shape of a C.

5. The device of claim 4 wherein said member has a flat top horizontal surface.

6. In combination with a manually operable trigger pump having a pump body and a circular cap disposed below the body and adapted to engage a container having material to be pumped out by said pump, said pump having a generally vertical trigger pivotally coupled at its upper end to said body and a linkage coupled at one end to said trigger at a point intermediate the ends of the trigger, said trigger having a surface adjacent said body, said surface having a longitudinally extending groove therein, said linkage extending from said coupled end into said body, said linkage being moved into said body when said trigger is pivoted in a vertical plane toward said body to operate said pump:

locking means detachably secured to the outer surface of said cap and manually rotatable about said cap; and a generally horizontal arm integral at one end with said locking means and extending radially outward from said cap, the other end of said arm having a tip engageable with and disengagable from said trigger surface groove, said means being rotatable to a locked position at which the tip engages said groove and the pivotable movement of said trigger toward the pump body is small enough to prevent trigger operation of the pump, whereby the pump is locked into an inoperative position, said pump being unlocked and in operative position when the trigger is pivoted in the opposite direction and the locking means is simultaneously rotated to move the tip out of engagement with the trigger surface whereby the trigger can be pivoted in normal operative manner.

* * * * *